United States Patent [19]

Bagley et al.

[11] 4,150,169

[45] Apr. 17, 1979

[54] METHOD FOR MANUFACTURING AN EMBOSSED VINYL SURFACE COVERING HAVING A CLEAR PHOTOPOLYMERIZED COATING

[75] Inventors: George E. Bagley; Robert H. Byers, both of Lancaster, Pa.

[73] Assignee: Armstrong Cork Company, Lancaster, Pa.

[21] Appl. No.: 864,464

[22] Filed: Dec. 27, 1977

[51] Int. Cl.[2] ..... B05D 3/06

[52] U.S. Cl. ..... 427/54; 427/270; 427/322; 427/407 F; 427/420

[58] Field of Search ..... 427/54, 322, 44, 407 E, 427/420, 407 F, 270; 204/159

[56] References Cited

U.S. PATENT DOCUMENTS

| | | | |
|---|---|---|---|
| 3,518,141 | 6/1970 | Bourns et al. | 428/61 X |
| 3,924,023 | 12/1975 | Boranian et al. | 427/54 |
| 4,016,334 | 4/1977 | Collins et al. | 428/463 |

FOREIGN PATENT DOCUMENTS

| | | | |
|---|---|---|---|
| 12084 | 1975 | Japan | 427/44 |

OTHER PUBLICATIONS

Toensmeier; Patrick A., "Curtain Coating for Corrugated Blanks," *Packaging,* Oct. 1960, p. B-13.

*Primary Examiner*—Ronald H. Smith
*Assistant Examiner*—Evan K. Lawrence

[57] ABSTRACT

In a method for manufacturing an embossed thermoplastic surface covering wherein a 100% reactive photopolymerizable coating is applied to the embossed thermoplastic substrate, the improvement comprising prewetting the valleys of the embossed substrate with a liquid consisting essentially of an acrylate monomer or a mixture of acrylate monomers and sufficient photoinitiator to initiate polymerization when the coated substrate is subjected to ultraviolet radiation.

2 Claims, 3 Drawing Figures

Fig. 1
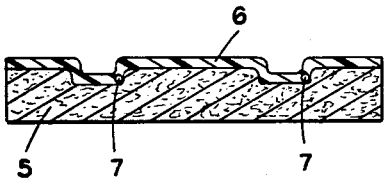
Fig. 2
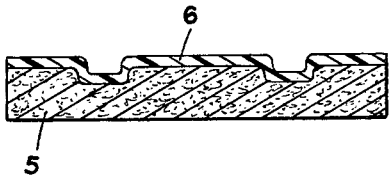
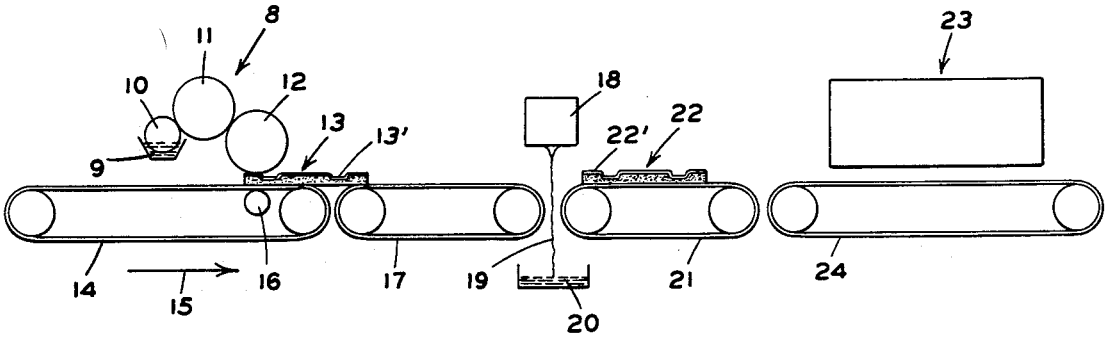
Fig. 3

METHOD FOR MANUFACTURING AN EMBOSSED VINYL SURFACE COVERING HAVING A CLEAR PHOTOPOLYMERIZED COATING

BACKGROUND OF THE INVENTION

1. Field of the Invention

This invention relates to a manufacturing method for providing an embossed thermoplastic surface covering with a photopolymerized wear layer.

2. Description of the Prior Art

The desirability of protecting vinyl substrates such as thermoplastic vinyl-asbestos tile and decorative thermoplastic sheet goods utilized as floor coverings has been well recognized, and recently such substrates, protected by clear, tough, mar-resistant coatings, which are substantially 100% reactive and photocured have become widely available. For example, U.S. Pat. No. 3,485,732 has suggested radiation curable coating compositions for application to plastic substrates such as linoleum, and U.S. Pat. No. 3,924,023 suggests the application of photopolymerizable coatings to vinyl-asbestos substrates. It is substrates of the latter type, which have first been embossed, with which this invention is illustrated, although it will be readily evident that the invention has application in coating any embossed thermoplastic substrate.

It has been discovered that when an embossed vinyl substrate, particularly adapted for surface coverings such as floors, is coated with conventional, photopolymerizable coating compositions utilizing a curtain coater to apply the photopolymerizable coating to the substrate, the application of conventional coatings of about 2 to 5 mils results in the occlusion of air bubbles within the coating along the leading edge of the deeper valleys of the vinyl substrate, i.e., those edges which first pass beneath the curtain coater. Such bubbles can prove to be highly disadvantageous if they, in turn, are near or at the upper surface of the coating in that, should they puncture or break under wear conditions, they provide sites for dirt entrapment. Since the preferred coatings are essentially 100% reactive, they are generally highly viscous, and when subjected to an ultraviolet light cure, any occluded air will become permanently entrapped in the coating at the time of cure.

SUMMARY OF THE INVENTION

It is an object of our invention to eliminate the air bubbles in the coating. This is accomplished by prewetting the valleys of the embossed substrate with a liquid having a viscosity between about 10 centipoises and 100 centipoises before curtain coating the substrate, said liquid consisting essentially of an acrylate monomer or mixture of acrylate monomers and sufficient photoinitiator to initiate polymerization when the curtain coated substrate is subjected to ultraviolet radiation. The coating applied by the curtain coater is compatible and curable with acrylate monomers.

DESCRIPTION OF THE DRAWINGS

In the drawings, FIG. 1 illustrates an embossed coated tile manufactured in accordance with the practice of the prior art, showing the occluded air bubbles immediately behind the leading edge of the deep valleys in the machine direction and in the cured coating;

FIG. 2 illustrates a coated embossed tile produced in accordance with this invention; and FIG. 3 diagrammatically illustrates the line set-up for manufacturing coated embossed vinyl substrates in accordance with this invention.

DESCRIPTION OF THE INVENTION AND PREFERRED EMBODIMENTS

By way of example, this invention will be described in connection with the manufacture of an embossed vinyl asbestos tile substrate, although it will be obvious that the invention is applicable to embossed thermoplastic substrates, generally, either in tile or sheet form.

With reference to the drawings, FIG. 1 illustrates in cross section an embossed vinyl-asbestos tile substrate 5 having a photopolymerizable coating 6 and occluded air bubbles as shown by the numeral 7. FIG. 2 illustrates a tile prepared in accordance with the invention, including the embossed vinyl-asbestos tile substrate 5 and the photopolymerized coating 6.

The method for producing the coated tile in accordance with the invention is diagrammatically illustrated in FIG. 3. As shown in FIG. 3, an embossed vinyl-asbestos tile substrate 13 is first passed beneath a Schmutch printer 8, which applies a liquid acrylate coating from a reservoir 9 onto the surface of the tile, the coating being squeezed down into the valleys 13, to thoroughly wet the embossed tile substrate. The Schmutch printer has a wooden roll 10 which picks up the liquid from the reservoir 9 and transfers it to an etched chrome-plated roll 11 (Anilox Roll) which, in turn, transfers the coating onto a rubber roll 12 which is in contact with the tile passing thereunder. A steel back-up roll 16 forms a nip opening with conveyor 14 and roll 12. The machine direction is illustrated by the arrow 15 and conveyor 14 carries the tile underneath the printer 8 and onto conveyor 17. Conveyor 17 conveys the tile underneath the curtain coater 18, the curtain coater applying a curtain of liquid onto the tile, illustrated by numeral 22, with the excess liquid going into a reservoir 20, the tile, after being coated, is picked up by conveyor 21 which, in turn, transfers the tile to conveyor 24 which conveys the tile under a conventional photocuring system, in this instance, a battery of four, 200-watt per inch, medium pressure mercury arc lamps.

The following is an example of a 100% reactive photopolymerizable coating which cures to yield a tough, clear, mar-resistant coating when subjected to a source of ultraviolet radiation.

EXAMPLE 1

| Ingredient | Parts by weight (gms) |
|---|---|
| 4,4' diisocyanato dicyclohexyl methane | 251.1 |
| Trimethylolpropane diallyl ether | 254.2 |
| Allyl diglycol carbonate | 76.0 |
| Polycaprolactone triol* (Union Carbide PCP0301 - molecular weight 300, hydroxy number 560) | 68.2 |
| Catalyst (Dibutyltin dilaurate) | 0.59 |
| Trimethylolpropane Tris(beta-mercapto-propionate) | 339.7 |
| Phosphorous Acid | 0.2 |
| Diethoxyacetophenone | 9.8 |
| Pyrogallol | .1 |

*The polycaprolactone diol is prepared by polymerizing epsilon-caprolactone with trimethylol propane. (U.S. Patent 2,914,556)

In preparing the coating, the trimethylolpropane diallyl ether is reacted with two equivalents of 4,4' diisocyanato-dicyclohexyl methane using 0.59 grams of dibutyltin dilaurate catalyst at a temperature of about 80° C. for one hour. The allyl diglycol carbonate and the polycaprolactone triol are then added and reacted at 80° C. until there are no free —NCO groups. The trimethylolpropane tris(beta-mercaptoproprionate), phosphorous acid, diethoxyacetophenone and pyrogallol are then mixed with the coating.

The coating, as prepared, has a viscosity of about 6000 centipoises at 25° C. It is heated to about 170° F. in the curtain coater, giving a coating viscosity of about 900 centipoises.

The following is an example of a prewetting liquid which may be used in the practice of this invention:

EXAMPLE 2

| Ingredients | Parts by weight (gms) |
|---|---|
| Trimethylolpropane triacrylate | 75 |
| 2-ethylhexyl acrylate | 25 |
| Methyl diethanolamine | 3 |
| Benzophenone | 3 |

At 30° C., the prewetting liquid has a viscosity of about 21 centipoises and is applied at room temperature.

With reference to the drawing, wherein the production line is diagrammatically illustrated, the prewetting liquid is fed to the reservoir 9, where it is picked up by the wooden roll 10. The overall etched roll 11 picks up a measured amount of liquid from roll 10, the amount determined by the extent of etching, in this instance, approximately 3000 cells per square inch are etched into the chrome-plated printing roll. The measured amount is transferred to the rubber roll 12 and, at a speed of about 110 feet per minute, results in an application of one gram per square foot of embossed tile fed under the printer 8.

A one foot by one foot standard commercial embossed vinyl-asbestos tile 13 is fed through the printer 8 at a speed of 110 feet per minute on conveyor 14 in the machine direction indicated by the arrow 15. The rubber roll 14 transfers sufficient liquid of the formulation of Example 2 at the nip established by roll 12 and back-up roll 16 to give a wet pick-up of a total of about one gram of liquid, most of which is forced into the valleys to thoroughly wet out all the depressions indicated by the numerals 13'. The wetted tile 13 is then transported by conveyors 17 and 21 beneath the curtain coater 18 at a line speed of about 400 feet per minute, where a curtain 19 of the photopolymerizable coating of Example 1 is applied wet-on-wet to provide an overall coating pick-up 22' on tile 22 of about 11 grams or an even overall coating thickness of about 4 mils (0.004 inches or 1000 microns). The coated tile 22 is then picked up by the conveyor 24 and transported under an ultraviolet light source 23 comprised of a battery of four in-line, 200 watt per inch, medium pressure mercury arc lamps at a line speed of 13.2 feet per minute. This dosage of ultraviolet light cures both coatings and yields an embossed tile with an overall clear 4 mil thick film which is tough and mar-resistant. No air bubbles are visible in the coating.

When the tile is fed directly to the curtain coater 18 by passing the printer 8, bubbles of air are occluded by the viscous coating immediately behind the leading edge of the valleys 13'. This is illustrated in FIG. 1, which shows a cross-sectional view of an embossed vinyl-asbestos tile substrate 5 having a photopolymerized coating 6 with occluded air bubbles 7. FIG. 2 shows the same tile wherein a prewetting liquid has first been applied at the printer 8 before coating at the curtain coater 18 and curing at 23.

A further example of a wetting liquid that may be used in the practice of this invention is as follows:

EXAMPLE 3

| Ingredient | Parts by weight (gms) |
|---|---|
| 1,6-hexanediol diacrylate | 99.0 |
| Benzoin isobutyl ether | 1.0 |

The above liquid, as formulated, has a viscosity of about 13 centipoises at 30° C. It works equally as well as the coating of Example 2 in prewetting the embossed substrate to eliminate air bubbles in the cured coated tile and is fully compatible and curable with the ultraviolet curable coating of Example 1.

Acrylate diluents comprise a major component of most ultraviolet light curable coatings, and the formulations of Examples 2 and 3 are fully compatible with such coatings.

Generally, the prewetting liquid should be formulated to give a viscosity in the range of about 10 to 100 centipoises and should consist essentially of a liquid mono, di- or tri-ethylenically unsaturated acrylate component together with sufficient photopolymerization initiator to allow polymerization at the ultraviolet light curing stage. Preferably between about ½ gram to 2 grams per square foot of embossed substrate are utilized to ensure that the valleys are fully prewetted and that the properties of the wear layer are not adversely affected.

What is claimed is:

1. In a method for manufacturing an embossed thermoplastic surface covering having a clear, durable, tough, mar-resistant photopolymerized wear layer wherein an embossed substrate is coated by passing the substrate beneath a curtain coater which applies a 100% reactive photopolymerizable coating to the substrate, said coating being compatible and curable with acrylate monomers, and wherein the coated substrate is cured by subjecting the coated substrate to a source of ultraviolet radiation, the improvement comprising:

prewetting the valleys of the embossed substrate with a liquid having a viscosity of between about 10 centipoises and 100 centipoises before curtain coating the substrate, said liquid consisting essentially of an acrylate monomer or a mixture of acrylate monomers and sufficient photoinitiator to initiate polymerization when the curtain coated substrate is subjected to ultraviolet radiation.

2. The method in accordance with claim 1 in which between about ½ to 2 grams per square foot of said liquid is used to prewet the substrate.

* * * * *